US008300008B2

(12) United States Patent
Miyamoto

(10) Patent No.: US 8,300,008 B2
(45) Date of Patent: Oct. 30, 2012

(54) METHOD FOR OPERATING ELECTROPHORETIC DISPLAY APPARATUS, ELECTROPHORETIC DISPLAY APPARATUS, AND ELECTRONIC SYSTEM

(75) Inventor: Tsutomu Miyamoto, Shiojiri (JP)

(73) Assignee: Seiko Epson Corporation (JP)

( * ) Notice: Subject to any disclaimer, the term of this patent is extended or adjusted under 35 U.S.C. 154(b) by 498 days.

(21) Appl. No.: 12/561,682

(22) Filed: Sep. 17, 2009

(65) Prior Publication Data

US 2010/0127966 A1 May 27, 2010

(30) Foreign Application Priority Data

Nov. 27, 2008 (JP) ..... 2008-302922

(51) Int. Cl.
*G09G 3/34* (2006.01)

(52) U.S. Cl. ..... 345/107; 345/79; 345/84; 345/208

(58) Field of Classification Search ..... 345/79, 345/107, 208, 84
See application file for complete search history.

(56) References Cited

U.S. PATENT DOCUMENTS 6,115,012 A * 9/2000 Eguchi et al. ..... 345/84
7,973,747 B2 * 7/2011 Ono et al. ..... 345/79
2003/0067666 A1 4/2003 Kawai
2003/0094914 A1 * 5/2003 Yanagita et al. ..... 318/560
2006/0028427 A1 * 2/2006 Katase ..... 345/107
2006/0202949 A1 * 9/2006 Danner et al. ..... 345/107
2008/0165170 A1 * 7/2008 Nagao et al. ..... 345/208
2009/0135136 A1 * 5/2009 Orsley ..... 345/157

FOREIGN PATENT DOCUMENTS

JP 2003-140199 5/2003

* cited by examiner

*Primary Examiner* — Thuy Pardo
(74) *Attorney, Agent, or Firm* — Harness, Dickey & Pierce, P.L.C.

(57) ABSTRACT

A method for operating an electrophoretic display apparatus including a first substrate; a second substrate; an electrophoretic device being held between the first substrate and the second substrate and containing electrophoretic particles; a first electrode formed on a surface of the first substrate, the surface facing the electrophoretic device; and a second electrode formed on a surface of the second substrate, the surface facing the electrophoretic device is provided. The method includes image displaying in which a voltage is applied to the electrophoretic device. The image displaying includes device driving in which the electrophoretic device is driven by inputting a first potential into the first electrode and inputting a second potential into the second electrode, and accumulated-charge removing in which a potential of the first electrode is changed, from the first potential to the second potential, stepwise or uniformly at a potential change velocity lower than a potential change velocity upon starting of the device driving.

7 Claims, 10 Drawing Sheets

PRIOR ART

PRIOR ART

METHOD FOR OPERATING ELECTROPHORETIC DISPLAY APPARATUS, ELECTROPHORETIC DISPLAY APPARATUS, AND ELECTRONIC SYSTEM

BACKGROUND

1. Technical Field

The present invention relates to a method for operating an electrophoretic display apparatus, an electrophoretic display apparatus, and an electronic system.

2. Related Art

There is an electrophoretic display apparatus having a configuration in which an electrophoretic device containing a liquid-phase dispersion medium and electrophoretic particles is held between a pair of substrates. Such an electrophoretic display apparatus is configured to display an image by applying a voltage to a pair of electrodes between which the electrophoretic device is held to thereby change the distribution of electrophoretic particles (for example, see JP-A-2003-140199).

An electrophoretic display apparatus described in JP-A-2003-140199 has a configuration in which an insulation member is provided on a surface of an electrode. To suppress self-erasing of an electrophoretic device in this configuration, JP-A-2003-140199 states that changing a waveform from having a sharp drop to having a gradual decrease upon stopping of voltage application to electrodes prevents a voltage with a reversed polarity from being applied to the electrodes.

SUMMARY

The techniques described in JP-A-2003-140199 are intended to suppress self-erasing of an electrophoretic device due to an insulation member formed on an electrode. However, such self-erasing can also occur even in a configuration where an insulation member is not formed on an electrode because an electrophoretic device has a capacitance and an electric resistance.

FIGS. 10A to 10C are schematic views showing circuit configurations of an electrophoretic display apparatus. Referring to FIG. 10A, an electrophoretic display apparatus 500 has a configuration in which an electrophoretic device 32, a power supply E, and a switch circuit SW are connected via wiring. The electrophoretic device 32 can be represented as a circuit including a parallel connection of a capacitor Cep and an electric resistor Rep.

Referring to FIG. 10A, to drive the electrophoretic device 32 in the electrophoretic display apparatus 500, the switch circuit SW is made to be in the on-state and a driving voltage V is applied to the electrophoretic device 32 using the power supply E. In this way, the electrophoretic device 32 is driven to have a desired display status. After that, as shown in FIG. 10B, the switch circuit SW is made to be in the off-state.

After the application of the driving voltage V using the power supply E is stopped, charge accumulated in the capacitor Cep of the electrophoretic device 32 due to the application of the driving voltage V is released as a current i passing through the electric resistor Rep of the electrophoretic device 32. In this case, referring to FIG. 10C, when the amount of the current i upon release of the charge is large, electrophoretic particles p move together with the charge. Specifically, negatively charged electrophoretic particles being attracted to an electrode having a higher potential move toward the other electrode having a lower potential after stopping of voltage application; and positively charged electrophoretic particles move conversely.

FIG. 11 is a timing chart showing a known operation method used for a pixel 40 shown in FIG. 4A. The pixel 40 includes a selection transistor 41, a pixel electrode 35, a common electrode 37, and the electrophoretic device 32. Details of the components in FIG. 4A will be described in Description of Exemplary Embodiments below.

At a time t0 in FIG. 11, a potential Gate of a gate electrode 41*e* of the selection transistor 41 is at a high level (H, for example, 40 V), a potential DATA of a source electrode 41*c* of the selection transistor 41 is at a low level (L, for example, 0 V), and a potential COM of the common electrode 37 is at a high level (H, for example, 40 V). At this time, the pixel 40 is in a state of high reflectivity (H) and displays white.

After an image display operation is started, the potential COM of the common electrode 37 is changed to a low level (L, for example, 0 V) at a time t1, and subsequently the potential DATA of the source electrode 41*c* of the selection transistor 41 is changed to a high level (H, for example, 40 V) at a time t2. Subsequently, the potential Gate of the gate electrode 41*e* of the selection transistor 41 is changed to a low level (L, for example, 0 V) at a time t3 and the selection transistor 41 is made to be in the on-state. Thus, the potential DATA (high level) is input into the pixel electrode 35. As a result, an electric field formed between the pixel electrode 35 and the common electrode 37 drives the electrophoretic device 32. Thus, the pixel 40 enters a state of low reflectivity (L) (displaying black).

Subsequently, the potential Gate of the gate electrode 41*e* of the selection transistor 41 is changed to the high level at a time t5 and the selection transistor 41 is made to be in the off-state. Subsequently, the potential DATA of the source electrode 41*c* is changed to the low level at a time t6.

In the above-described known operation method, potential input into the pixel electrode 35 is stopped by changing the selection transistor 41 to be in the off-state while the potential DATA of the source electrode 41*c* is at the high level and the potential COM of the common electrode 37 is at the low level. As a result, as shown in FIG. 10B, charge accumulated in the capacitor Cep of the electrophoretic device 32 moves between the pixel electrode 35 and the common electrode 37 via the electric resistor Rep of the electrophoretic device 32. In this case, as described above, electrophoretic particles (black particles 26 and white particles 27) move together with charge moving between the electrodes when the amount of the current i passing through the electric resistor Rep is large. Referring to FIG. 11, this increases the reflectivity from the time t5 and degrades the contrast of black display.

An advantage of some aspects of the invention is that a method for operating an electrophoretic display apparatus is provided in which self-erasing due to capacitance and electric resistance of the electrophoretic device is suppressed and an excellent image retention characteristic is achieved. Another advantage of some aspects of the invention is that an electrophoretic display apparatus having an excellent image retention characteristic is provided.

An aspect of the invention is directed to a method for operating an electrophoretic display apparatus including a first substrate; a second substrate; an electrophoretic device being held between the first substrate and the second substrate and containing electrophoretic particles; a first electrode formed on a surface of the first substrate, the surface facing the electrophoretic device; and a second electrode formed on a surface of the second substrate, the surface facing the electrophoretic device. This method includes: image displaying in which a voltage is applied to the electrophoretic device, the image displaying including device driving in which the electrophoretic device is driven by inputting a first potential into the first electrode and inputting a second potential into the second electrode, and accumulated-charge removing in which a potential of the first electrode is changed, from the first potential to the second potential, stepwise or uniformly at a potential change velocity lower than a potential change velocity upon starting of the device driving.

According to this method, charge accumulated in the capacitor of the electrophoretic device during the device driving is released by controlling the potential of the first electrode during the accumulated-charge removing. This can reduce the amount of current passing through the electrophoretic device upon the release of the charge accumulated in the capacitor. This can effectively suppress the occurrence of self-erasing in which electrophoretic particles move together with the current. Thus, according to the above-described aspect of the invention, an excellent image retention characteristic can be achieved.

It is preferable that, in the accumulated-charge removing, the potential change velocity for the first electrode is set to a maximum value of a range in which self-erasing of the electrophoretic device does not occur.

This can suppress degradation of contrast due to self-erasing and can stabilize the potential of the first electrode in a short period of time after the image displaying.

It is preferable that, in the accumulated-charge removing, the potential change velocity for the first electrode is in a region represented by Expression (1) below:

$$v_e \leqq |V1-V2|/\tau \quad (1)$$

where $v_e$ represents the potential change velocity for the first electrode, V1 represents the first potential, V2 represents the second potential, and $\tau$ represents a time constant of the electrophoretic device.

An electrophoretic device is generally designed so that self-erasing does not occur even when the charge of the electrodes is naturally discharged after a driving voltage is instantaneously turned off. However, the electric resistance of an electrophoretic device varies in accordance with variation in environmental temperature, the water content of the electrophoretic device, or the like. For this reason, an electrophoretic device in which self-erasing does not occur at normal temperature can suffer from self-erasing due to change in the temperature condition.

To deal with this problem, it is preferable that the potential change velocity $v_e$ be in the above-described region. This can reduce the amount of current passing through the electrophoretic device to a value less than or equal to the maximum amount of current upon naturally discharging the charge of electrodes. As a result, the occurrence of degradation of contrast due to self-erasing can be reduced even when the temperature condition changes.

It is preferable that, in the accumulated-charge removing, driving signals having a waveform for changing the potential of the first electrode at a constant velocity are input into the first electrode.

This can minimize the time over which the potential of the first electrode changes from the first potential to the second potential in the accumulated-charge removing.

It is preferable that, the electrophoretic display apparatus further includes a transistor on the first substrate, the transistor including a drain terminal connected to the first electrode, and, in the accumulated-charge removing, selection signals having a waveform for changing the potential of the first electrode at a constant velocity are input into a gate terminal of the transistor.

This also can minimize the time over which the potential of the first electrode changes from the first potential to the second potential in the accumulated-charge removing.

It is preferable that the image displaying further include temperature correcting in which the potential change velocity for the first electrode in the accumulated-charge removing is corrected in accordance with environmental temperature, the temperature correcting being performed prior to the accumulated-charge removing.

This can suppress the occurrence of self-erasing with certainty even when change in environmental temperature increases the occurrence of self-erasing, and can provide a more excellent image retention characteristic.

According to another aspect of the invention, an electrophoretic display apparatus includes a first substrate; a second substrate; an electrophoretic device being held between the first substrate and the second substrate and containing electrophoretic particles; a first electrode formed on a surface of the first substrate, the surface facing the electrophoretic device; a second electrode formed on a surface of the second substrate, the surface facing the electrophoretic device; and a voltage control section that applies a driving voltage to the electrophoretic device. The voltage control section is configured to drive the electrophoretic device to display an image by conducting a device driving operation in which the electrophoretic device is driven by inputting a first potential into the first electrode and inputting a second potential into the second electrode; and an accumulated-charge removing operation in which a potential of the first electrode is changed, from the first potential to the second potential, stepwise or uniformly at a potential change velocity lower than a potential change velocity upon starting of the device driving operation.

According to this apparatus, the accumulated-charge removing operation is conducted after the device driving operation. In the accumulated-charge removing operation, charge accumulated in the capacitor of the electrophoretic device in the device driving operation is released by controlling the potential of the first electrode. This can reduce the amount of current passing through the electrophoretic device upon the release of the charge accumulated in the capacitor. This can effectively suppress the occurrence of self-erasing in which electrophoretic particles move together with the current. Thus, according to the above-described aspect of the invention, an excellent image retention characteristic can be achieved.

According to another aspect of the invention, an electronic system includes the electrophoretic display apparatus.

According to this aspect, an electronic system can be provided that includes a display unit having an excellent image retention characteristic and an excellent displaying quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
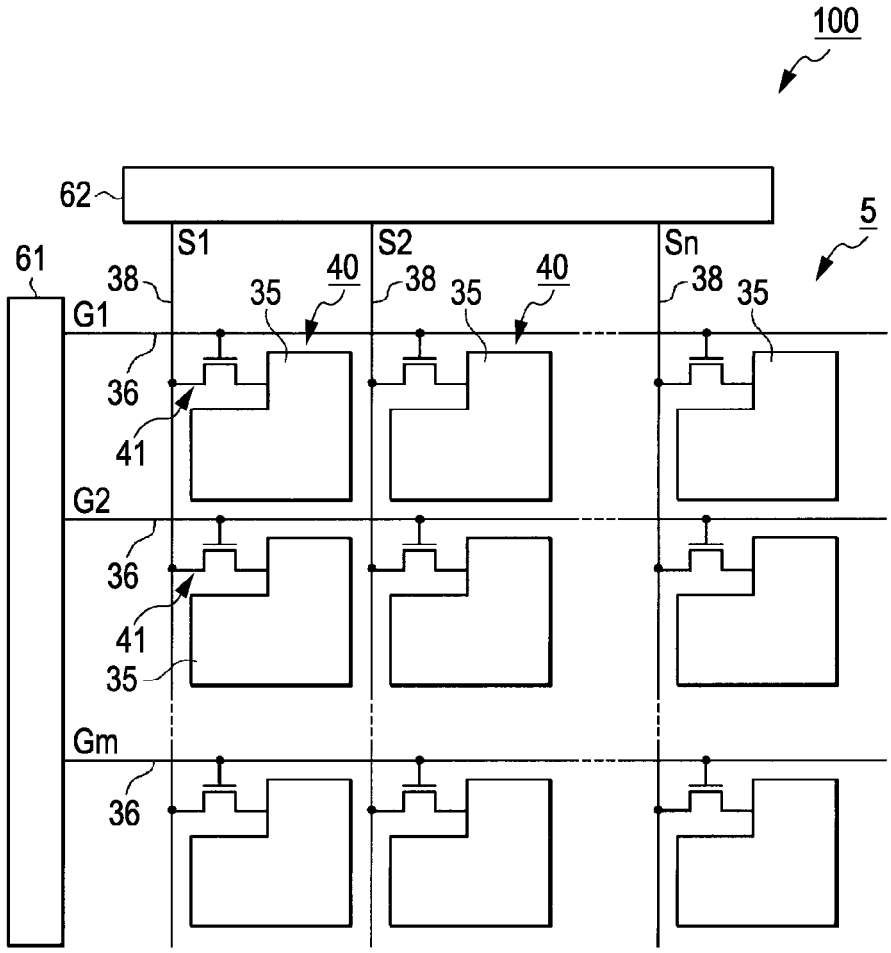
FIG. 1 is a schematic view of the configuration of an electrophoretic display apparatus 100 according to an embodiment.

Hereinafter, electrophoretic display apparatuses according to embodiments of the invention are described with reference to the drawings. Note that these embodiments are directed to electrophoretic display apparatuses driven by the active matrix system.

These embodiments are mere examples of the invention and they are not intended to restrict the invention. Various changes can be freely made in these embodiments without departing from the spirit and scope of the invention. The drawings have been made more readily understandable and the configurations shown in the drawings do not necessarily represent actual configurations.

FIG. 1 is a schematic view of the configuration of an electrophoretic display apparatus 100 according to an embodiment of the invention.

The electrophoretic display apparatus 100 includes a display section 5 in which a plurality of pixels 40 is arranged in a matrix. Provided in a region surrounding the display section 5 are a scanning line driving circuit 61 and a data line driving circuit 62. The display section 5 includes a plurality of scanning lines 36 extending from the scanning line driving circuit 61 and a plurality of data lines 38 extending from the data line driving circuit 62. The pixels 40 are provided so as to correspond to the intersections of the scanning lines 36 and the data lines 38. Each pixel 40 includes a selection transistor 41 connected to one of the scanning lines 36 and one of the data lines 38, and a pixel electrode 35 (first electrode) connected to the selection transistor 41.

The scanning line driving circuit 61 is connected to the pixels 40 via 1 to m scanning lines 36 (G1, G2, . . . , Gm). The scanning line driving circuit 61 sequentially selects these 1 to m scanning lines 36 and feeds selection signals to the pixels 40 via a scanning line 36 being selected, the selection signals defining the on-timing of the selection transistors 41 provided in the pixels 40.

The data line driving circuit 62 is connected to the pixels 40 via 1 to n data lines 38 (S1, S2, . . . , Sn). The data line driving circuit 62 feeds image signals defining pixel data to each pixel 40.

Figure 2A:
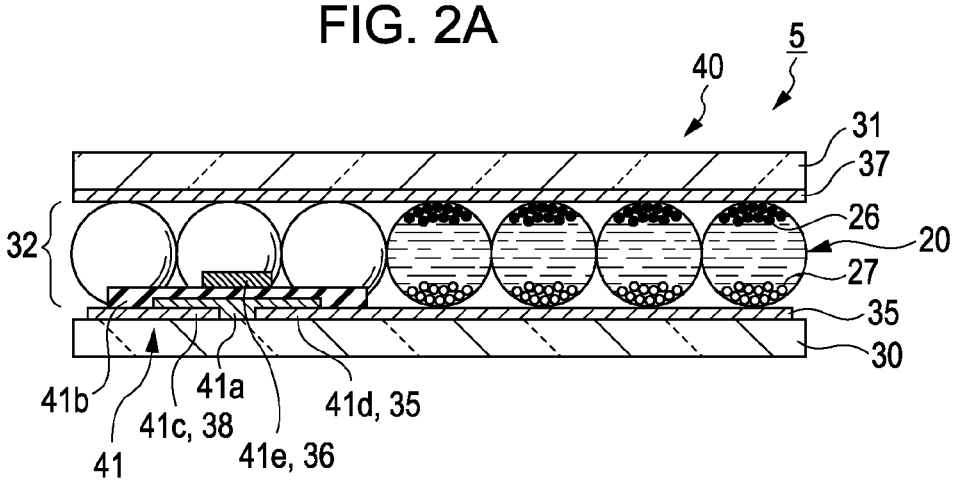
FIG. 2A is a fragmentary sectional view of an electrophoretic display apparatus, the sectional view showing a portion corresponding to a pixel.

FIG. 2A is a fragmentary sectional view of the electrophoretic display apparatus 100, the sectional view showing a portion corresponding to one of the pixels 40 provided in the display section 5. The electrophoretic display apparatus 100 includes a device substrate (first substrate) 30, a counter substrate (second substrate) 31, and an electrophoretic device 32 including a plurality of microcapsules 20 being arranged, the electrophoretic device 32 being held between the device substrate 30 and the counter substrate 31.

In the display section 5, the pixel electrode 35 (first electrode), the scanning line 36, the data line 38, and the selection transistor 41 are formed on a surface of the device substrate 30, the surface facing the electrophoretic device 32.

The device substrate 30 is formed of glass, plastic, or the like. Since the device substrate 30 is disposed on a side opposite an image display surface, the device substrate 30 is not necessarily transparent. In particular, the present embodiment employs organic transistors described below as the selection transistors 41 and hence a plastic substrate that is inexpensive, light weight, and flexible can be used as the device substrate 30.

The pixel electrodes 35 are configured to apply a driving voltage to the electrophoretic device 32. Each pixel electrode 35 may have a configuration obtained by sequentially plating a nickel layer and a gold layer on a Cu (copper) foil. Alternatively, the pixel electrode 35 may be formed of Al, ITO (indium tin oxide), or the like. Alternatively, the pixel electrode 35 may be formed of, for example, Cr, Ta, Mo, Nb, Ag, Pt, Pd, In, Nd, or an alloy of the foregoing; a conductive oxide such as $InO_2$ or $SnO_2$; a conductive polymer such as polyaniline, polypyrrole, polythiophene, or polyacetylene; a conductive polymer mixed with a dopant, for example, an acid such as hydrochloric acid, sulfuric acid, or sulfonic acid, an Lewis acid such as $PF_6$, $AsF_5$, or $FeCl_3$, atoms of a halogen such as iodine, or atoms of a metal such as sodium or potassium; or a conductive composite material containing carbon black or metal particles being dispersed.

The scanning lines 36 and the data lines 38 may be formed of a material or materials among the above-described materials for the pixel electrodes 35.

Each selection transistor 41 includes a semiconductor layer 41*a*, a gate insulation film 41*b*, a source electrode 41*c*, a drain electrode 41*d*, and a gate electrode 41*e*. In the embodiment, the source electrode 41*c* is constituted by a portion of the data line 38, the drain electrode 41*d* is constituted by a portion of the pixel electrode 35, and the gate electrode 41*e* is constituted by a portion of the scanning line 36.

The semiconductor layer 41*a* is an organic semiconductor layer containing an organic semiconductor material. The semiconductor layer 41*a* is formed on the device substrate 30 with portions of the semiconductor layer 41*a* being formed on the source electrode 41*c* and the drain electrode 41*d*.

An example of such an organic semiconductor material is a polymeric organic semiconductor material such as poly(3-alkylthiophene), poly(3-hexylthiophene) (P3HT), poly(3-octylthiophene), poly(2,5-thienylenevinylene) (PTV), poly (para-phenylenevinylene) (PPV), poly(9,9-dioctylfluorene) (PFO), poly(9,9-dioctylfluorene-co-bis-N,N'-(4-methoxyphenyl)-bis-N,N'-phenyl-1,4-phenylenediamine) (PFMO), poly(9,9-dioctylfluorene-co-benzothiadiazole) (BT), a fluorene-triallylamine copolymer, a triallylamine-based polymer, or a fluorene-bithiophene copolymer (e.g. poly(9,9-dioctylfluorene-co-dithiophene) (F8T2)); $C_{60}$, a metal phthalocyanine complex, or a substituted derivative of the foregoing; an acene molecular material such as anthracene, tetracene, pentacene, or hexacene; or α-oligothiophenes, specifically, a low-molecular-weight organic semiconductor such as quarterthiophene (4T), sexithiophene (6T), or octathiophene. These examples may be used alone or in combination as a mixture.

Non-limiting examples of a method for forming an organic semiconductor film include vacuum deposition, molecular beam epitaxy, CVD, sputtering, plasma polymerization, electrolytic polymerization, chemical polymerization, ion plating, spin coating, casting, immersion coating, Langmuir-Blodgett method, spraying, ink jet method, roll coating, bar coating, dispensing, silk screening, dip coating, and the like. For example, a mask having openings for providing a desired pattern is aligned with the device substrate 30 and then an organic semiconductor film may be formed through the mask by one of the above-described methods. Alternatively, a uniformly formed organic semiconductor layer may be partially etched to thereby form a semiconductor layer having different thicknesses among regions. Among the methods described above, preferred are methods in which a semiconductor layer is formed by coating a material solution by ink jet method or dispensing because the thickness of the resultant layer can be most easily controlled.

The gate insulation film 41*b* is selectively formed in a flat region covering the semiconductor layer 41*a*. A material used for forming the gate insulation film 41*b* is not particularly restricted as long as the material has an insulation property. Such an insulation material may be an organic material or an inorganic material. However, an organic insulation material is preferably used because use of an organic insulation material readily provides a good interface between the resultant organic insulation film and an organic semiconductor layer. The gate insulation film 41*b* that generally has good electric characteristics is formed of a material such as polyvinyl alcohol, polyethylene, polypropylene, polybutylene, polystyrene, polymethyl methacrylate, polyimide, polyvinyl phenol, polycarbonate, or para-xylylene. These materials may be used alone or in combination.

The gate electrode 41*e* is formed at a position facing the channel region of the semiconductor layer 41*a* with the gate insulation film 41*b* therebetween. The channel region is a region sandwiched by the source electrode 41*c* and the drain electrode 41*d*. The gate electrode 41*e* (scanning line 36) can be formed by etching a conductive film formed of one of the above-described materials. Alternatively, the gate electrode 41*e* may be formed by conducting vapor deposition of a conductive film onto the device substrate 30 through a metal through mask having openings for providing a desired pattern. Alternatively, the gate electrode 41*e* may be formed by selectively coating a solution containing conducive particles such as metal fine particles or graphite particles by ink jet method or the like.

A common electrode 37 (second electrode) being flat is formed on a surface of the counter substrate 31, the surface facing the electrophoretic device 32, so as to face the plurality of the pixel electrodes 35. The electrophoretic device 32 is provided on the common electrode 37.

The counter substrate 31 is formed of glass, plastic, or the like. The counter substrate 31, which is disposed on an image display surface side, is transparent. The common electrode 37 together with the pixel electrodes 35 apply a voltage to the electrophoretic device 32. The common electrode 37 is a transparent electrode formed of MgAg (magnesium silver), ITO (indium tin oxide), IZO (indium zinc oxide), or the like.

The electrophoretic device 32 is held between the pixel electrodes 35 and the common electrode 37. The electrophoretic device 32 may be preformed, on the counter substrate 31 side, as an electrophoretic sheet including an adhesive used for bonding to the device substrate 30. Such an adhesive may fill the gaps among the microcapsules 20 or may be provided as an adhesive layer covering the electrophoretic device 32 formed on the counter substrate 31.

Figure 2B:
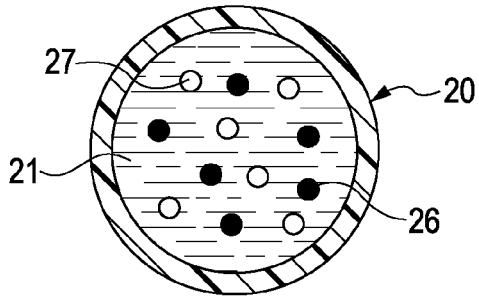
FIG. 2B is a sectional view of a microcapsule.

FIG. 2B is a schematic sectional view of one of the microcapsules 20. Each microcapsule 20 has a spherical shape having a diameter of, for example, about 50 μm. Each microcapsule 20 contains dispersion medium 21, a plurality of white particles (electrophoretic particles) 27, and a plurality of black particles (electrophoretic particles) 26. Referring to FIG. 2A, the microcapsules 20 are held between the common electrode 37 and the pixel electrodes 35 such that one or more microcapsules 20 correspond to each pixel 40.

The shells (wall membranes) of the microcapsules 20 are formed of a polymeric resin having a sufficiently high light transmittance such as an acrylic resin such as polymethyl methacrylate or polyethyl methacrylate, a urea resin, or gum arabic.

The dispersion medium 21 is liquid for dispersing the white particles 27 and the black particles 26 in the microcapsules 20. Non-limiting examples of the dispersion medium 21 include water, alcohol-based solvents (methanol, ethanol, isopropanol, butanol, octanol, methyl cellosolve, or the like), esters (ethyl acetate, butyl acetate, or the like), ketones (acetone, methyl ethyl ketone, methyl isobutyl ketone, or the like), aliphatic hydrocarbons (pentane, hexane, octane, or the like), alicyclic hydrocarbons (cyclohexane, methylcyclohexane, or the like), aromatic hydrocarbons (benzene, toluene, benzenes including a long alkyl chain such as xylene, hexylbenzene, heptylbenzene, octylbenzene, nonylbenzene, decylbenzene, undecylbenzene, dodecylbenzene, tridecylbenzene, tetradecylbenzene, or the like), halogenated hydrocarbons (methylene chloride, chloroform, carbon tetrachloride, 1,2-dichloroethane, or the like), carboxylates, and the like. Alternatively, another oil may be used as the dispersion medium 21. These listed compounds may be used alone or in combination as a mixture. These listed compounds may be mixed with a surfactant or the like.

The white particles 27 are particles (a high polymer or colloid) formed of a white pigment such as titanium dioxide, hydrozincite, or antimony trioxide. The white particles 27 are charged, for example, negatively. The black particles 26 are particles (a high polymer or colloid) formed of a black pigment such as aniline black or carbon black. The black particles 26 are charged, for example, positively.

When necessary, such a pigment may be mixed with a charge control agent including particles of an electrolyte, a surfactant, metal soap, a resin, rubber, oil, varnish, a compound, or the like; a dispersing agent such as a titanium-based coupling agent, an aluminum-based coupling agent, or a silane-based coupling agent; a lubricant; a stabilizing agent; or the like.

Alternatively, instead of the black particles 26 and the white particles 27, for example, a red pigment, a green pigment, a blue pigment, or the like may also be used. When a red pigment, a green pigment, a blue pigment, or the like is used, red, green, blue, or the like can be respectively shown in the display section 5.

Figure 2C:
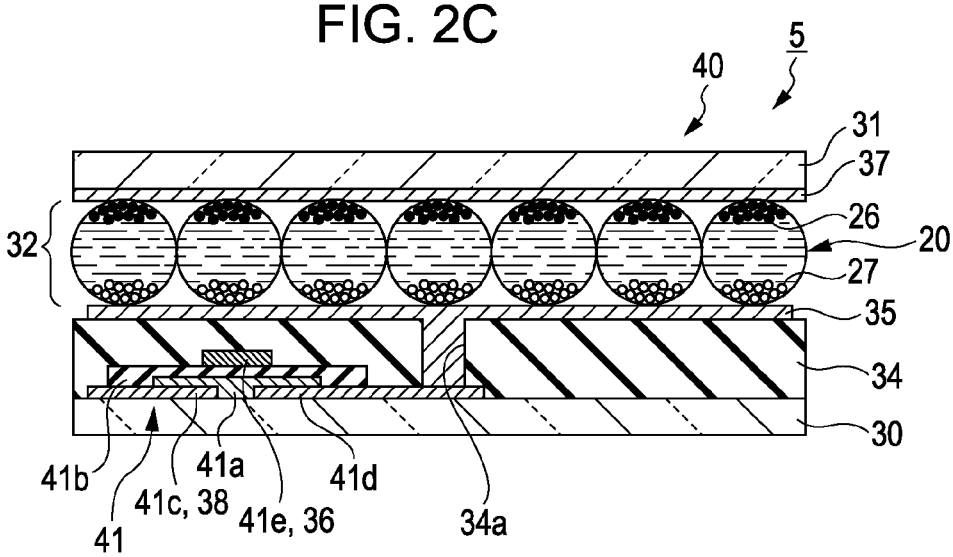
FIG. 2C is a sectional view of an electrophoretic display apparatus having another configuration.

Alternatively, the electrophoretic display apparatus 100 may have another configuration of the pixels 40 whose sectional view is shown in FIG. 2C. In this configuration, each selection transistor 41 is formed on the device substrate 30 and the selection transistor 41 is, in turn, covered with an insulation layer 34 formed of silicon oxide, an acrylic resin, an epoxy resin, or the like. Each pixel electrode 35 is formed on the insulation layer 34. The pixel electrode 35 is connected to the drain electrode 41*d* of the selection transistor 41 via a contact hole 34*a* extending through the insulation layer 34 to the drain electrode 41*d*.

The configuration shown in FIG. 2C provides a higher aperture ratio of the pixels 40 than the configuration shown in FIG. 2A because the surface of the device substrate 30 is substantially covered by the pixel electrodes 35 in the configuration shown in FIG. 2C. The configuration shown in FIG. 2C also provides good adhesion between the electrophoretic device 32 and the device substrate 30 because the device substrate 30 side surface is substantially flat. In this configuration, the insulation layer 34 can reduce an electric field formed in the vicinity of the selection transistors 41 while the electrophoretic device 32 is driven, thereby reducing degradation of displaying quality due to electric field leakage.

Figure 3A:
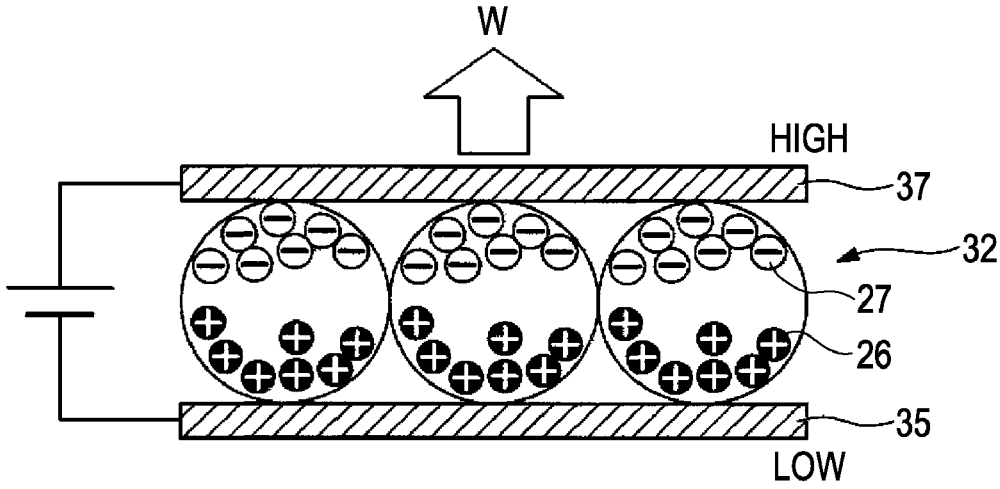
FIGS. 3A and 3B are explanatory views for operations of electrophoretic devices.
Figure 3B:
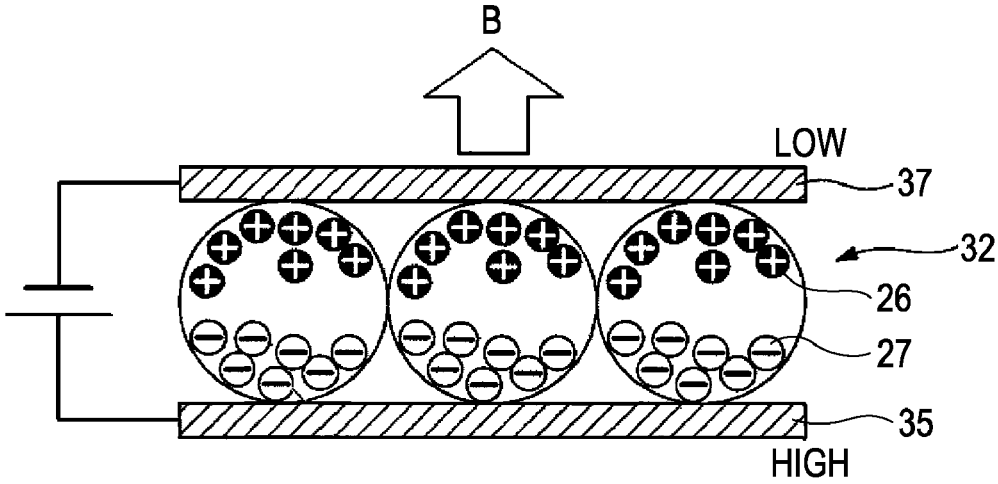

FIGS. 3A and 3B are explanatory views showing operations of the electrophoretic device 32. FIG. 3A corresponds to the case where the pixel 40 displays white. FIG. 3B corresponds to the case where the pixel 40 displays black.

Referring to FIG. 3A, where the pixel 40 displays white, the common electrode 37 is maintained at a relatively high potential while the pixel electrode 35 is maintained at a relatively low potential. In this state, the negatively charged white particles 27 are attracted toward the common electrode 37 while the positively charged black particles 26 are attracted toward the pixel electrode 35. As a result, the pixel 40 displays white (W) when viewed from the common electrode 37 side, which is the display surface side.

Referring to FIG. 3B, where the pixel 40 displays black, the common electrode 37 is maintained at a relatively low potential while the pixel electrode 35 is maintained at a relatively high potential. In this state, the positively charged black particles 26 are attracted toward the common electrode 37 while the negatively charged white particles 27 are attracted toward the pixel electrode 35. As a result, the pixel 40 displays black (B) when viewed from the common electrode 37 side.

Hereinafter, a method for operating the electrophoretic display apparatus 100 having the above-described configuration will be described with reference to FIGS. 4A to 6B.

Figure 4A:
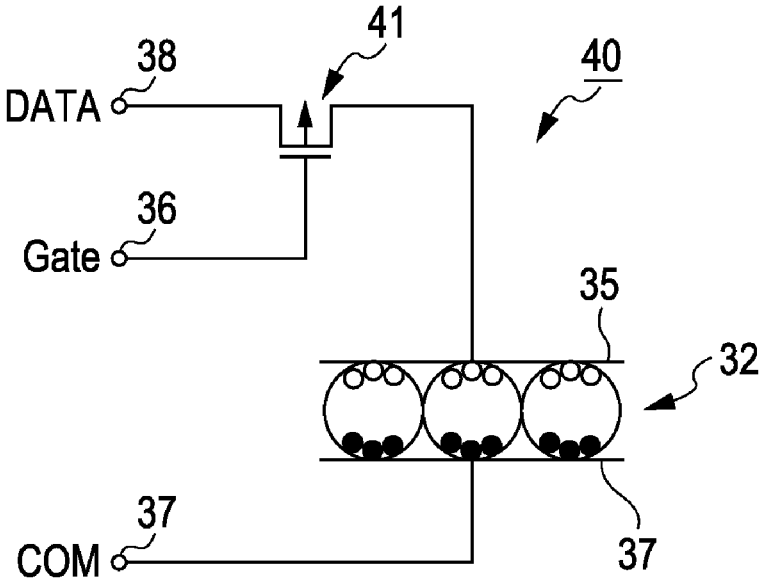
FIGS. 4A and 4B show circuit configurations of a pixel.
Figure 4B:
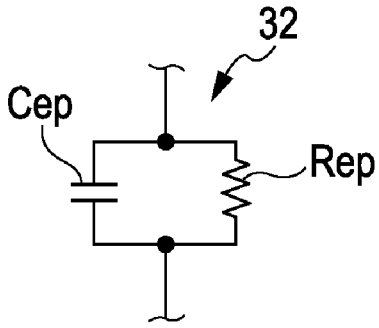
Figure 5:
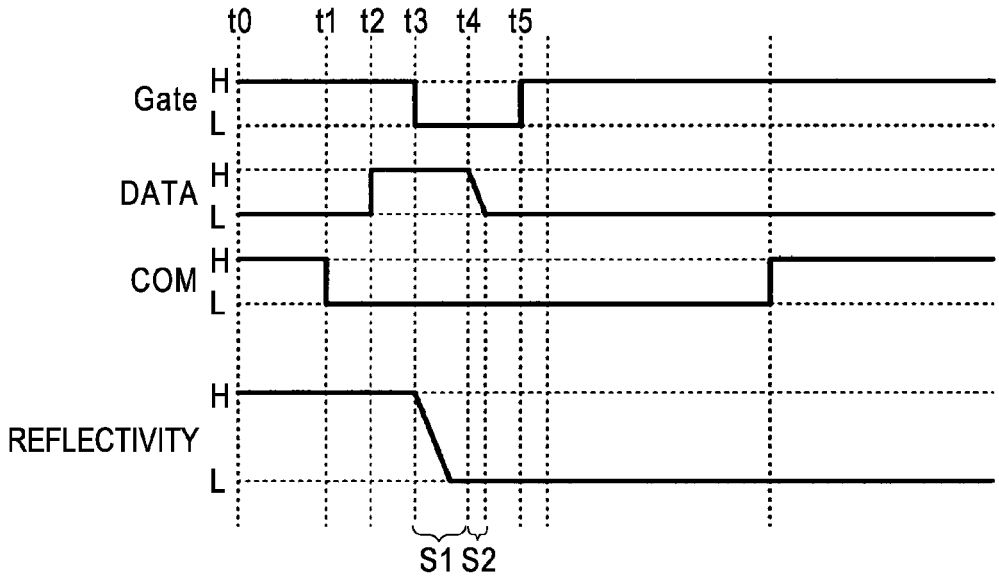
FIG. 5 is a timing chart showing an operation method according to an embodiment.
Figure 6A:
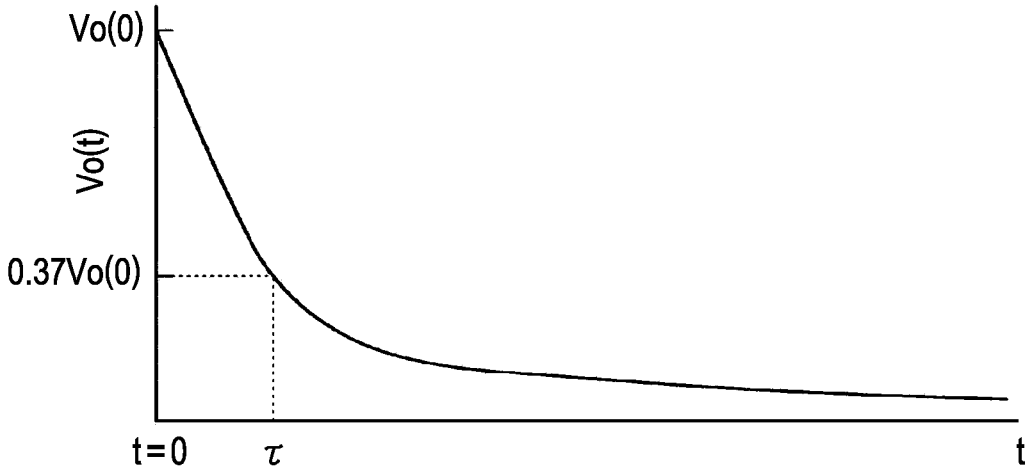
FIGS. 6A and 6B are explanatory views for an operation method according to an embodiment.
Figure 6B:
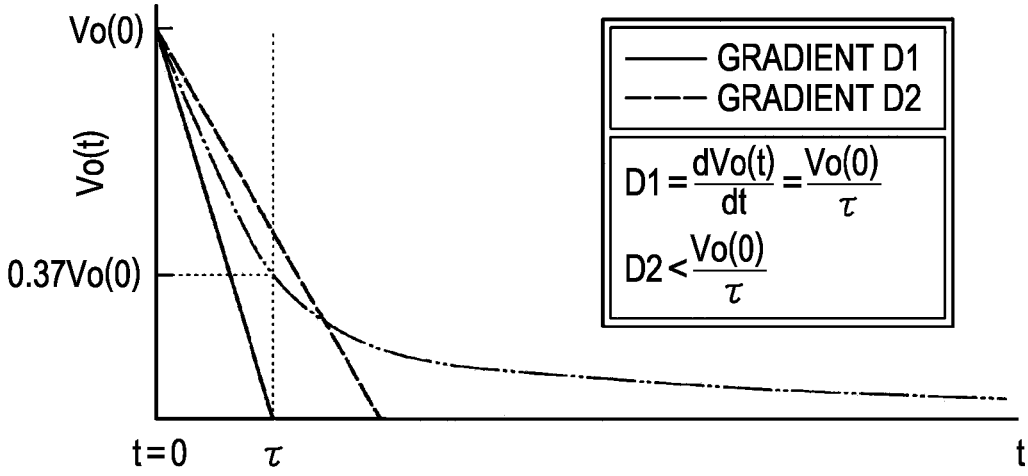

FIGS. 4A and 4B show circuit configurations of each pixel 40. FIG. 5 is a timing chart used in the case where one of the pixels 40 displays black. FIGS. 6A and 6B are explanatory views for an operation method according to an embodiment of the invention.

Referring to FIG. 4A, the selection transistor 41 is a P-channel transistor. Referring to FIG. 4B, the electrophoretic device 32 is represented as a circuit including a parallel connection of a capacitor Cep and an electric resistor Rep.

FIG. 5 shows a potential Gate of the gate electrode 41*e* of the selection transistor 41 shown in FIG. 4A, a potential DATA of the source electrode 41*c* (data line 38) of the selection transistor 41, a potential COM of the common electrode 37, and the reflectivity of the display surface of the pixel 40.

An image is displayed in the display section 5 by inputting predetermined potentials into the pixel electrode 35 and the common electrode 37 of the pixel 40 in the image display area to thereby apply a driving voltage to the electrophoretic device 32 (microcapsules 20). At the starting time of an image displaying operation (time t0) in FIG. 5, the potential Gate of the gate electrode 41*e* of the selection transistor 41 is at a high level (H, for example, 40 V), the potential DATA of the source electrode 41*c* of the selection transistor 41 is at a low level (L, for example, 0 V, second potential), and the potential COM of the common electrode 37 is at a high level (H, for example, 40 V). At this time, the pixel 40 is in a state of high reflectivity (H) and displays white.

After the image displaying operation is started, the potential COM of the common electrode 37 is changed to a low level (L, for example, 0 V, second potential) at a time t1, and subsequently the potential DATA of the source electrode 41*c* of the selection transistor 41 is changed to a high level (H, for example, 40 V, first potential) at a time t2.

Subsequently, the potential Gate of the gate electrode 41*e* of the selection transistor 41 is changed to a low level (L, for example, 0 V) at a time t3 (device driving step S1). This makes the selection transistor 41 to be in the on-state and the potential DATA (high level, first potential) of the source electrode 41*c* (data line 38) is input into the pixel electrode 35 via the selection transistor 41. As a result, a voltage equivalent to the potential difference between the pixel electrode 35 (high level, first potential) and the common electrode 37 (low level, second potential) is applied to the electrophoretic device 32. This results in the state shown in FIG. 3B where the black particles 26 in the electrophoretic device 32 are attracted toward the common electrode 37. Thus, the pixel 40 enters a state of low reflectivity (L) and displays black.

Subsequently, from a time t4, the potential DATA of the source electrode 41*c* is gradually changed from the high level (first potential) to the low level (second potential) at a uniform gradient (accumulated-charge removing step S2). At this time, the potential Gate of the gate electrode 41*e* is at the low level and the selection transistor 41 is in the on-state. Thus, the capacitor Cep of the electrophoretic device 32 is released at a constant gradient (charge-transfer rate) shown in FIG. 5 via the selection transistor 41.

Subsequently, the potential Gate of the gate electrode 41*e* of the selection transistor 41 is changed to the high level at a time t5, when the potential DATA of the source electrode 41*c* has been changed to the low level. This makes the selection transistor 41 to be in the off-state and the image displaying operation in the pixel 40 is complete.

According to the above-described operation method of the embodiment, self-erasing due to the capacitor Cep and the electric resistor Rep of the electrophoretic device 32 can be suppressed and a displayed image can be maintained to have a good contrast. Hereinafter, these advantages are described in detail.

Referring to FIG. 5, according to the operation method of the embodiment, the potential DATA of the source electrode 41*c* is gradually transferred to the low level while the selection transistor 41 is in the on-state, and the potential of the pixel electrode 35 has been changed to the low level before the selection transistor 41 is turned off. Specifically, after the electrophoretic device 32 is driven to be in the predetermined display state (displaying black), the accumulated charge of the capacitor Cep of the electrophoretic device 32 is released via not the electric resistor Rep of the electrophoretic device 32 but the selection transistor 41 in the on-state.

Thus, current passing through the electrophoretic device 32 can be suppressed after the application of a driving voltage to the electrophoretic device 32 is stopped, and hence the occurrence of self-erasing in the electrophoretic device 32 can be suppressed. As a result, as shown in FIG. 5, the reflectivity of the pixel 40 does not change after the image has been displayed and the image is maintained to have a good contrast.

In the operation method of the embodiment, the gradient at which the potential DATA is gradually changed (potential change velocity $v_e$) can be freely selected as long as $v_e$ is smaller than the potential change velocity of the potential DATA at the rise time (the time when the potential DATA is transferred from the low level to the high level). Specifically, unlike the known operation method shown in FIG. 11 where a driving voltage is instantaneously turned off, the potential change velocity $v_e$ can be set to a desired value when the potential DATA input via the selection transistor 41 can be gradually changed.

Although the potential DATA is changed at a constant rate (potential change velocity $v_e$) in the accumulated-charge removing step S2 in the embodiment, the potential DATA may also be changed stepwise. Note that even in the case where the potential DATA is changed stepwise, it is preferred that the potential DATA be changed between potentials not instantaneously but gradually.

Figure 10A:
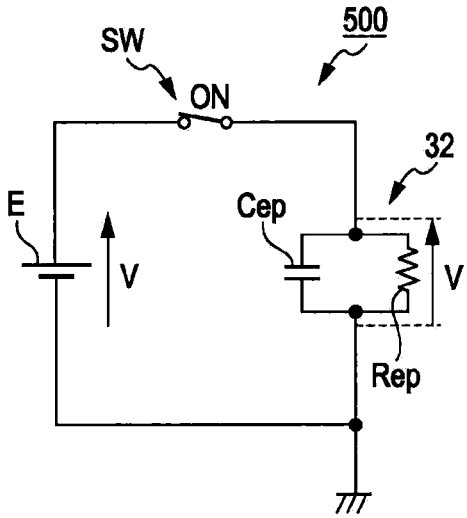
FIGS. 10A to 10C are explanatory views showing a known electrophoretic display apparatus.
Figure 10B:
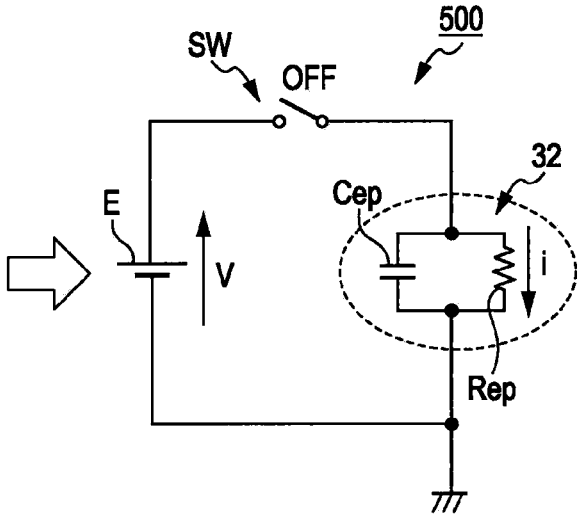
PRIOR ART FIG. 10B
Figure 10C:
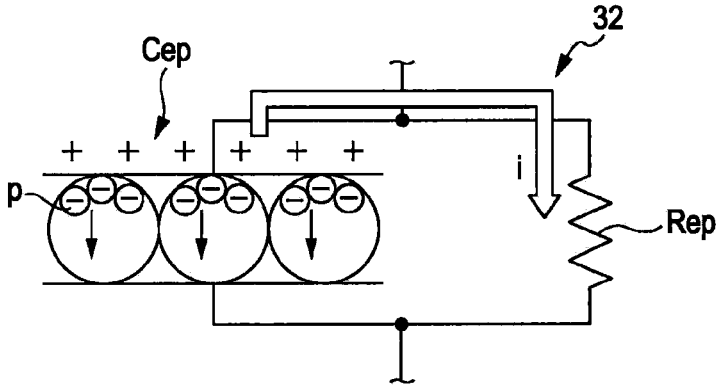
PRIOR ART FIG. 10C

As described above with reference to FIGS. 10A to 10C, the occurrence of the self-erasing phenomenon of the electrophoretic device 32 is dictated by the amount of current passing through the electrophoretic device 32 upon the release of the charge of the capacitor Cep and a characteristic (mobility of electrophoretic particles) of the electrophoretic device 32. The larger the potential change velocity $v_e$ at which the potential DATA is changed becomes, the larger the amount of current passing through the electrophoretic device 32 becomes. The smaller the potential change velocity $v_e$ at which the potential DATA is changed becomes, the smaller the amount of current passing through the electrophoretic device 32 becomes. Thus, the probability of the occurrence of self-erasing of the electrophoretic device 32 presumably increases as the potential change velocity $v_e$ increases. Conversely, the probability of the occurrence of self-erasing of the electrophoretic device 32 presumably decreases as the potential change velocity $v_e$ decreases.

Accordingly, the potential change velocity $v_e$ of the potential DATA in the embodiment is preferably set to the maximum value of a range in which self-erasing does not occur. As a result, variation in contrast due to self-erasing can be suppressed while the potential of the pixel electrode 35 can be stabilized in a short period of time. Thus, an excellent image retention characteristic can be achieved.

Figure 11:
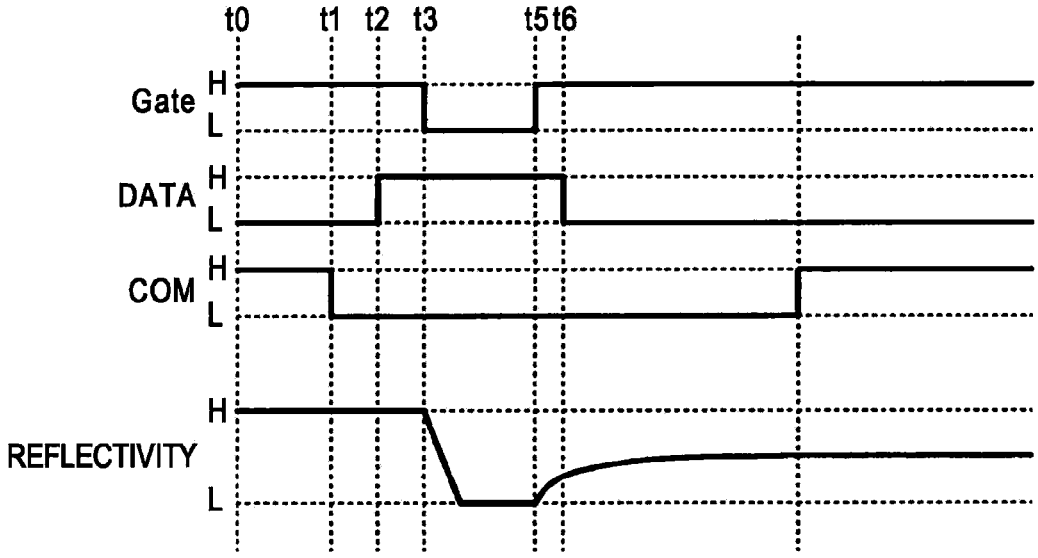
FIG. 11 is a timing chart showing a known operation method.

Consider the case where the driving voltage of the electrophoretic device 32 is instantaneously turned off as in a known operation method shown in FIG. 11. In this case, referring to FIG. 6A, the change of the potential of the pixel electrode 35 is represented by the curve in which the potential drops sharply in a short period of time and a decrease in the potential reduces over time. In this case, the time over which the initial potential Vo decreases to 0.37×Vo is defined as a time constant $\tau$. The time constant $\tau$ is determined by the capacitor Cep and the electric resistor Rep of the electrophoretic device 32.

The electrophoretic device 32 is generally designed so that self-erasing does not occur even when the potential Vo(t) of the pixel electrode 35 attenuates in accordance with the curve shown in FIG. 6A. However, electric characteristics of the electrophoretic device 32 vary in accordance with environmental conditions, in particular, considerably vary due to variation in the environmental temperature, the water content of the electrophoretic device 32, or the like. For this reason, the electrophoretic device 32 in which self-erasing does not occur at normal temperature and at normal humidity can suffer from self-erasing at high temperature and at high humidity.

To deal with this problem, the potential change velocity $v_e$ of the potential DATA is preferably set at a larger value than $Vo(0)/\tau$. Specifically, referring to FIG. 6B, the gradient of potential change (potential change velocity $v_e$) is preferably set to a gradient equivalent to the gradient D2, which is less inclined than the maximum gradient (gradient D1) of the curve upon natural discharge.

The amount of current upon the release of the charge of the capacitor Cep is at the maximum at a position where the potential changes most steeply. Specifically, in the curve shown in FIG. 6A, the amount of current is at the maximum at the start of discharge (t=0) and the potential change velocity at this time is equivalent to the gradient D1 shown in FIG. 6B. Thus, by setting the potential change velocity $v_e$ to the velocity equivalent to the gradient D2, which is less inclined than the gradient D1, the amount of current passing through the electrophoretic device 32 can be reduced with more certainty compared with the amount upon natural discharge. As a result, the probability of the occurrence of self-erasing can be reduced.

Referring to FIG. 6B, the potential DATA is linearly changed after the application of a driving voltage in the embodiment. This provides an advantage in that the time over which the potential of the pixel electrode 35 is stabilized can be reduced compared with the case of using an operation method of intentionally changing a waveform from having a sharp drop to having a gradual decrease, the waveform being input into the potential DATA (see JP-A-2003-140199).

This advantage of stabilizing the potential of the pixel electrode 35 is also provided when the potential change velocity $v_e$ is set to a velocity corresponding to the gradient D1.

As described above, the electric resistor Rep of the electrophoretic device 32 varies in accordance with environmental conditions, which results in variation in the probability of the occurrence of self-erasing. Accordingly, the potential change velocity $v_e$ is preferably changed in accordance with environmental temperature in the operation method of the embodiment. Specifically, an operation method further including the following temperature correcting step is preferably used: when the environmental temperature is normal temperature, the potential change velocity $v_e$ is set to a velocity corresponding to the gradient D1 shown in FIG. 6B; and when the environmental temperature is high enough to influence the occurrence of self-erasing, the potential change velocity $v_e$ is changed to a velocity corresponding to, for example, the gradient D2. This temperature correcting step may be performed before the device driving step S1, between the device driving step S1 and the accumulated-charge removing step S2, or during the device driving step S1.

Use of such an operation method can provide an electrophoretic display apparatus in which degradation of contrast due to self-erasing can be suppressed irrespective of environmental temperature.

First Modification

Although the case where the pixel 40 displays black was described in the above-described embodiment, the operation method according to the embodiment can also be suitably used for the case where the pixel 40 displays white.

Figure 7:
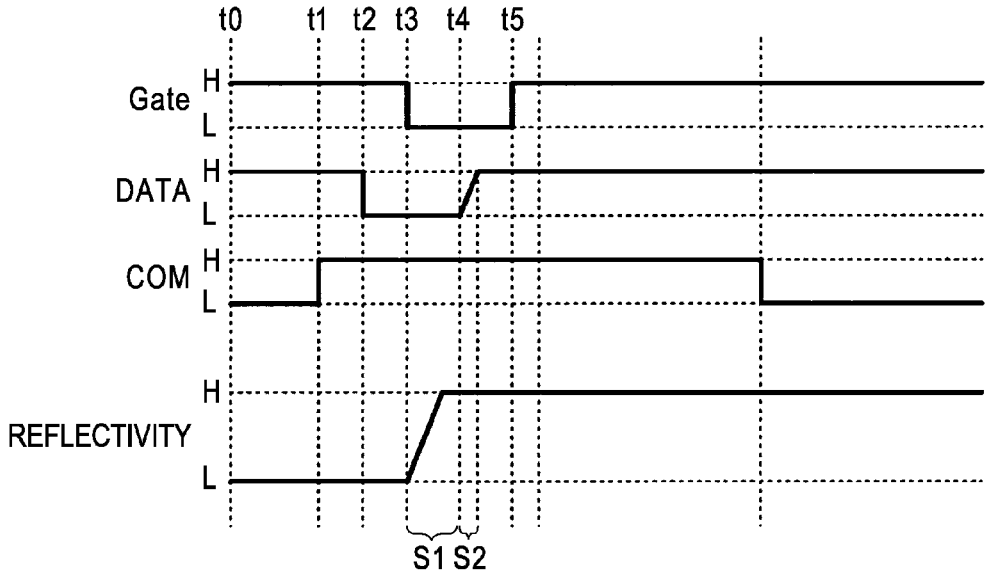
FIG. 7 is a timing chart showing an operation method according to a first modification.

FIG. 7 is a timing chart used in the case where the pixel 40 displays white.

Referring to FIG. 7 showing the case where the pixel 40 displays white, at a time t0, the potential Gate of the gate electrode 41*e* is set to a high level, the potential DATA of the source electrode 41*c* is set to a high level (second potential), and the potential COM of the common electrode 37 is set to a low level. At this time, the pixel 40 is in a state of low reflectivity (L) and displays black.

After the image displaying operation is started, the potential COM of the common electrode 37 is changed to a high level (second potential) at a time t1, and subsequently the potential DATA of the source electrode 41*c* is changed to a low level (first potential) at a time t2.

Subsequently, the potential Gate of the gate electrode 41*e* is changed to a low level at a time t3, which makes the selection transistor 41 to be in the on-state (device driving step S1). The potential DATA is then input into the pixel electrode 35 and the pixel electrode 35 is set at a low level (first potential). As a result, the potential difference between the pixel electrode 35 (low level, first potential) and the common electrode 37 (high level, second potential) drives the electrophoretic device 32. This increases the reflectivity of the pixel 40 and the pixel 40 enters a state of high reflectivity (H) and displays white.

Subsequently, from a time t4, the potential DATA of the source electrode 41*c* is gradually changed from the low level (first potential) to the high level (second potential) at a uniform gradient (accumulated-charge removing step S2). At this time, the potential Gate of the gate electrode 41*e* is at the low level and the selection transistor 41 is in the on-state. Thus, the capacitor Cep of the electrophoretic device 32 is released at a constant charge-transfer rate via the selection transistor 41.

Subsequently, the potential Gate of the gate electrode 41*e* of the selection transistor 41 is changed to the high level at a time t5, when the potential DATA of the source electrode 41*c* has been changed to the high level. This makes the selection transistor 41 to be in the off-state and the image displaying operation in the pixel 40 is complete.

According to the above-described operation method of the first modification, the capacitor Cep of the electrophoretic device 32 is also released by gradually changing the potential DATA in the accumulated-charge removing step S2 after the electrophoretic device 32 is driven. Thus, this method provides an advantage similar to that in the above-described embodiment and the occurrence of self-erasing of the electrophoretic device 32 can be suppressed. Therefore, use of an operation method according to the first modification permits maintaining of a good contrast in a displayed image.

Second Modification

Although the potential DATA of the source electrode 41*c* of the selection transistor 41 is gradually changed in the accumulated-charge removing step S2 in the above-described embodiment, the potential of the pixel electrode 35 may also be gradually changed with the gate voltage of the selection transistor 41.

Figure 8:
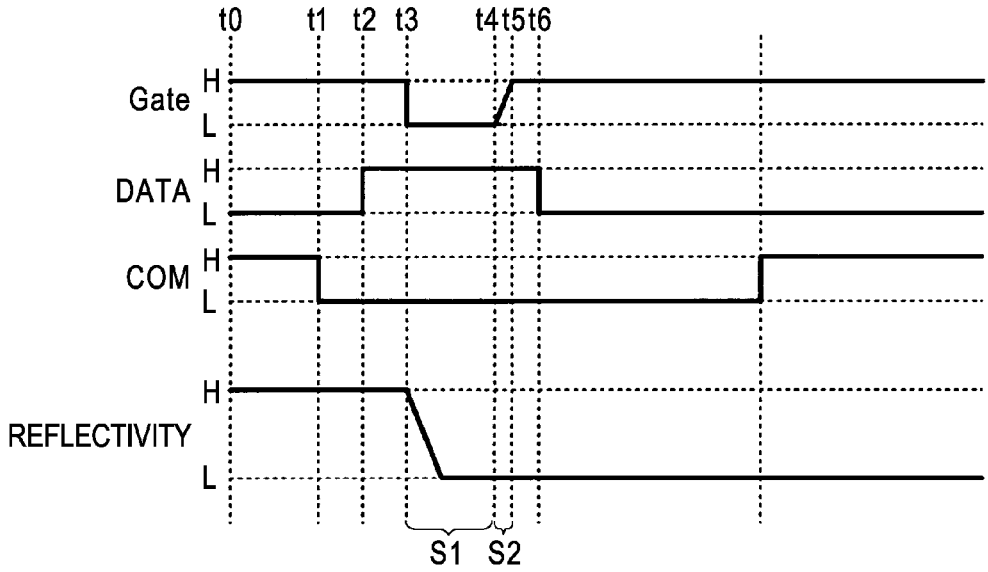
FIG. 8 is a timing chart showing an operation method according to a second modification.

FIG. 8 is a timing chart used in the case where the accumulated-charge removing step S2 is performed by controlling the potential Gate of the gate electrode 41*e*.

At the starting time (time t0) of an image displaying operation in FIG. 8, the potential Gate of the gate electrode 41*e* is set at a high level, the potential DATA of the source electrode 41*c* is set at a low level, and the potential COM of the common electrode 37 is set at a high level. At this time, the pixel 40 is in a state of high reflectivity (H) and displays white.

After the image displaying operation is started, the potential COM of the common electrode 37 is changed to a low level (second potential) at a time t1, and subsequently the potential DATA of the source electrode 41*c* is changed to a high level (first potential) at a time t2.

Subsequently, the potential Gate of the gate electrode 41*e* is changed to a low level at a time t3, which makes the selection transistor 41 to be in the on-state (device driving step S1). The potential DATA is then input into the pixel electrode 35 and the pixel electrode 35 is set at a high level (first potential). As a result, the potential difference between the pixel electrode 35 (high level, first potential) and the common electrode 37 (low level, second potential) drives the electrophoretic device 32. This decreases the reflectivity of the pixel 40 and the pixel 40 enters a state of low reflectivity (L) and displays black.

Subsequently, from a time t4, the potential Gate of the gate electrode 41*e* is gradually changed from the low level to the high level at a uniform gradient (accumulated-charge removing step S2). At this time, the potential DATA of the source electrode 41*c* is maintained at the high level (first potential) and the potential COM of the common electrode 37 is maintained at the low level (second potential). However, since the potential ($V_{gs}$) between the gate and the source of the selection transistor 41 gradually decreases, the potential of the drain electrode 41*d* of the selection transistor 41 (that is, the potential of the pixel electrode 35) gradually decreases from the high level (first potential) to the low level (second potential). As a result, charge accumulated in the capacitor Cep from the time t3 to the time t4 is released at a constant rate via the selection transistor 41.

Subsequently, at a time t5 when the potential Gate of the gate electrode 41*e* is changed to the high level, the selection transistor 41 is made to be in the off-state. Subsequently, at a time t6, the potential DATA of the source electrode 41*c* is set to the low level and the image displaying operation in the pixel 40 is complete.

According to the above-described operation method of the second modification, the capacitor Cep of the electrophoretic device 32 is also released by gradually changing the potential of the pixel electrode 35 in the accumulated-charge removing step S2 after the electrophoretic device 32 is driven. Thus, this method provides an advantage similar to that in the above-described embodiment and the occurrence of self-erasing can be suppressed in the electrophoretic device 32. Therefore, use of the operation method according to the second modification permits maintaining of a good contrast in a displayed image.

In the case where the pixel 40 displays white according to the second modification, during the time t2 to the time t6, the potential DATA of the source electrode 41*c* should be changed to the low level and the potential COM of the common electrode 37 should be changed to the high level. This case also can provide an advantage similar to that in the above-described second modification.

Note that, in the first and second modifications, the potential change velocity $v_e$ is preferably set in the same manner as in the above-described embodiment.

Electronic System

Hereinafter, the case where the electrophoretic display apparatus 100 of the above-described embodiment is applied to an electronic system is described.

Figure 9A:
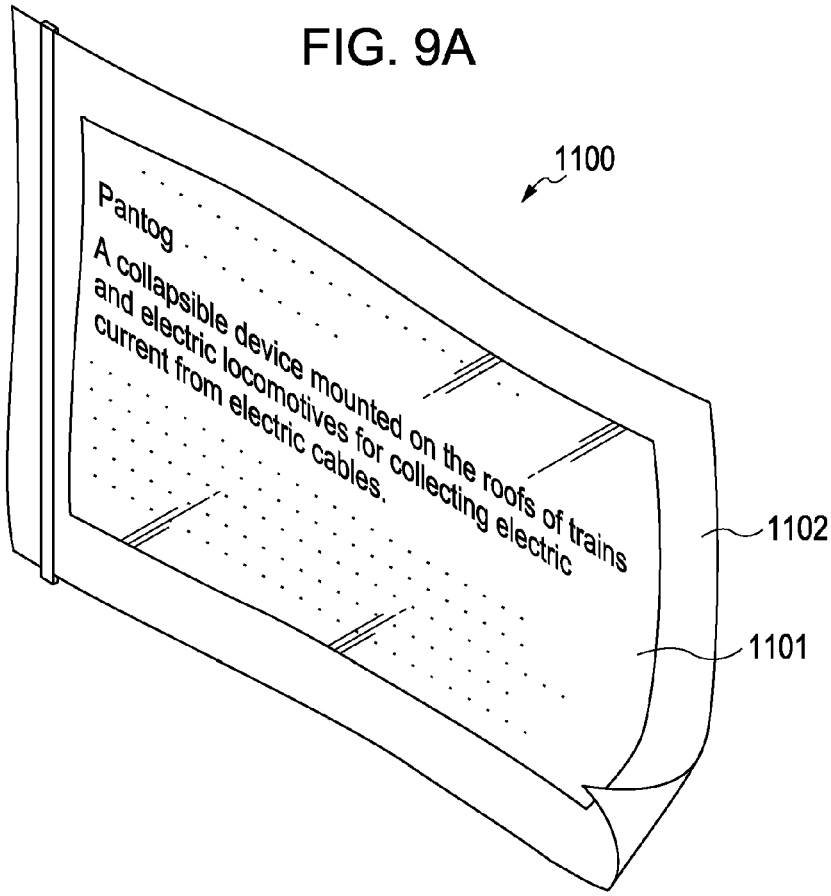
FIGS. 9A and 9B are perspective views showing examples of electronic systems.

FIG. 9A is a perspective view showing the configuration of an electronic paper 1100. The electronic paper 1100 includes the electrophoretic display apparatus 100 of the above-described embodiment in a display area 1101. The electronic paper 1100 also includes a body 1102 including a sheet that is bendable, has a texture and a flexibility similar to those of ordinary paper, and is rewritable.

Figure 9B:
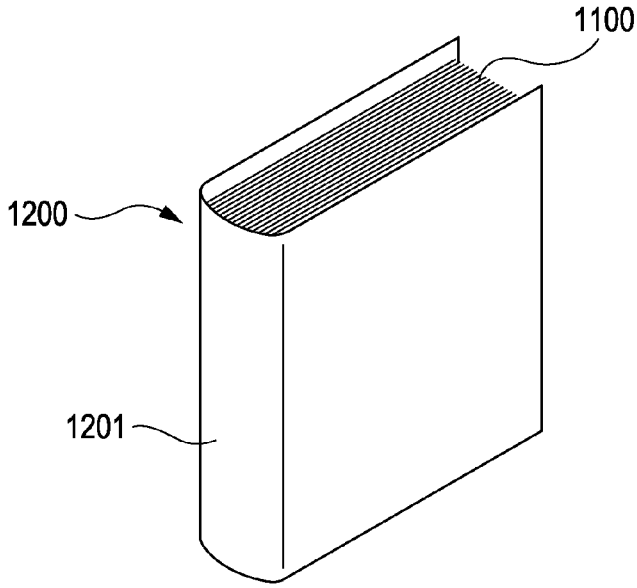

FIG. 9B is a perspective view showing the configuration of an electronic note 1200. The electronic note 1200 includes a stack of a plurality of the electronic papers 1100 and a cover 1201 sandwiching the stack therein. The cover 1201 includes a display data inputting unit (not shown) for inputting display data, for example, being fed by an external device. This unit allows changing or updating of the content being displayed in accordance with the display data in the state that the electronic papers are stacked.

The electronic paper 1100 and the electronic note 1200, which include the electrophoretic display apparatus 100 according to an embodiment of the invention, are electronic systems including a display unit having an excellent image retention characteristic and provides excellent displaying quality.

Note that the above-described electronic systems are mere examples of electronic systems according to embodiments of the invention and are not intended to restrict the technical scope of the invention. For example, an electrophoretic display apparatus according to an embodiment of the invention is also suitably applicable to the display units of electronic systems such as cellular phones or portable audio units.

The entire disclosure of Japanese Patent Application No. 2008-302922, filed Nov. 27, 2008 is expressly incorporated by reference herein.

What is claimed is:

1. A method for operating an electrophoretic display apparatus, the electrophoretic display apparatus including:

a first substrate;

a second substrate;

an electrophoretic device being held between the first substrate and the second substrate and containing electrophoretic particles;

a first electrode formed on a surface of the first substrate, the surface facing the electrophoretic device; and a second electrode formed on a surface of the second substrate, the surface facing the electrophoretic device, the method comprising:

image displaying in which a voltage is applied to the electrophoretic device, the image displaying including device driving in which the electrophoretic device is driven by inputting a first potential into the first electrode and inputting a second potential into the second electrode, and accumulated-charge removing in which a potential of the first electrode is changed, from the first potential to the second potential, stepwise or uniformly at a potential change velocity lower than a potential change velocity upon starting of the device driving, wherein, in the accumulated-charge removing, the potential change velocity for the first electrode is in a region represented by Expression (1) below:

$$v_e \leqq |V1-V2|/\tau \quad (1)$$

where $v_e$ represents the potential change velocity for the first electrode, V1 represents the first potential, V2 represents the second potential, and $\tau$ represents a time constant of the electrophoretic device.

2. The method according to claim 1, wherein, in the accumulated-charge removing, the potential change velocity for the first electrode is set to a maximum value of a range in which self-erasing of the electrophoretic device does not occur.

3. The method according to claim 1, wherein, in the accumulated-charge removing, driving signals having a waveform for changing the potential of the first electrode at a constant velocity are input into the first electrode.

4. The method according to claim 1, wherein the electrophoretic display apparatus further includes a transistor on the first substrate, the transistor including a drain terminal connected to the first electrode, and wherein, in the accumulated-charge removing, selection signals having a waveform for changing the potential of the first electrode at a constant velocity are input into a gate terminal of the transistor.

5. The method according to claim 1, wherein, the image displaying further includes temperature correcting in which the potential change velocity for the first electrode in the accumulated-charge removing is corrected in accordance with environmental temperature, the temperature correcting being performed prior to the accumulated-charge removing.

6. An electrophoretic display apparatus comprising:

a first substrate;

a second substrate;

an electrophoretic device being held between the first substrate and the second substrate and containing electrophoretic particles;

a first electrode formed on a surface of the first substrate, the surface facing the electrophoretic device;

a second electrode formed on a surface of the second substrate, the surface facing the electrophoretic device; and a voltage control section that applies a driving voltage to the electrophoretic device, wherein the voltage control section is configured to drive the electrophoretic device to display an image by conducting a device driving operation in which the electrophoretic device is driven by inputting a first potential into the first electrode and inputting a second potential into the second electrode, and an accumulated-charge removing operation in which a potential of the first electrode is changed, from the first potential to the second potential, stepwise or uniformly at a potential change velocity lower than a potential change velocity upon starting of the device driving operation, wherein, in the accumulated-charge removing operation, the potential change velocity for the first electrode is in a region represented by Expression (1) below:

$$v_e \leqq |V1-V2|/\tau \quad (1)$$

where $v_e$ represents the potential change velocity for the first electrode V1 represents the first potential, V2 represents the second potential, and $\tau$ represents a time constant of the electrophoretic device.

7. An electronic system comprising the electrophoretic display apparatus according to claim 6.

* * * * *